US005197845A

United States Patent [19]

Snead

[11] Patent Number: 5,197,845

[45] Date of Patent: Mar. 30, 1993

[54] CONVEYOR SYSTEM FOR SELF-UNLOADING TRAIN

[76] Inventor: Edwin D. Snead, 701 E. University Ave., Georgetown, Tex. 78626

[21] Appl. No.: 657,411

[22] Filed: Feb. 19, 1991

[51] Int. Cl.[5] ..... B61D 7/00

[52] U.S. Cl. ..... 414/339; 414/528; 414/398; 414/505; 198/836.2; 198/813; 105/157.1

[58] Field of Search ..... 414/334, 335, 339, 340, 414/343, 345, 349, 351, 352, 353, 527, 528, 398, 505; 105/240, 157.1, 160.5, 182.1, 199.1; 198/836.2, 861.2, 813

[56] References Cited

U.S. PATENT DOCUMENTS

| | | | |
|---|---|---|---|
| 1,207,237 | 12/1916 | Stuart | 414/398 X |
| 2,892,534 | 6/1959 | Ogden . | |
| 2,955,546 | 10/1960 | Liebherr et al. | 105/157.1 X |
| 3,072,242 | 1/1963 | Poundstone | 198/192 |
| 3,133,508 | 5/1964 | Sensenich | 105/157.1 X |
| 3,245,519 | 4/1966 | Reinemann | 198/202 |
| 3,368,665 | 2/1968 | Jinkins | 198/202 |
| 4,163,550 | 8/1979 | Armstrong | 198/836.2 X |
| 4,506,782 | 3/1985 | Jeanneret et al. | 198/806 |
| 4,538,722 | 9/1985 | Sumner | 198/861.2 |
| 4,576,538 | 3/1986 | Theurer et al. | 414/339 |
| 4,795,264 | 1/1989 | Riker | 414/339 X |
| 4,795,301 | 1/1989 | Snead et al. | 414/339 |
| 4,925,356 | 5/1990 | Snead et al. | 414/339 |

FOREIGN PATENT DOCUMENTS

| | | | |
|---|---|---|---|
| 263276 | 12/1988 | German Democratic Rep. | 198/813 |
| 124476 | 9/1979 | Japan | 198/836.2 |

*Primary Examiner*—Frank E. Werner
*Attorney, Agent, or Firm*—Harrison & Egbert

[57] ABSTRACT

A self-unloading train for the transfer of bulk commodities having a plurality of hopper cars coupled together, a train conveyor having an endless belt supported on the hopper cars in a position so as to receive material discharged from the hopper cars, and a conveyor guide positioned adjacent the discharge end of the train conveyor. The conveyor guide exerts a downward force onto the upper surface of the train conveyor. The conveyor guide comprises a frame affixed generally adjacent the discharge end of the train conveyor and a rotatable wheel connected to the frame. The rotatable wheel is in surface-to-surface contact with the upper surface of the train conveyor. A strut is connected to the rotatable wheel so as to adjust the angle of travel of the wheel relative to the curvature of the track and the curvature of the conveyor at the discharge end. Each of the hopper cars is connected to an adjacent car by an articulated coupling and by overlapping side bearings. The discharge end of the train conveyor is movable so as to overlap an adjacent hopper car in another plurality of hopper cars.

18 Claims, 6 Drawing Sheets

CONVEYOR SYSTEM FOR SELF-UNLOADING TRAIN

TECHNICAL FIELD

The present invention relates to a train for the transportation of bulk commodities. More particularly, the present invention relates to trains having conveyor systems built thereon. More particularly the present invention relates to the operation of such conveyor systems on curved sections of track.

BACKGROUND ART

Rail transportation is generally recognized as being more economical than truck transportation for bulk commodities such as aggregates. Large quantities of such commodities can be moved by a small crew at low costs. However, rail transportation frequently loses out in competitive situations because of the cost of unloading, stockpiling, and delivering the commodity to the ultimate destination.

Even though large quantities of bulk material can be transported at low costs from one terminal to another, the burden is placed on the unloading facility to maintain the economics of this method of transportation for the purchaser of the commodity. Even if the unloading is slow, the train is therefore delayed for a substantial period of time for the unloading to be accomplished, there is an added investment cost per ton handled for the use of the railroad equipment. One problem, in this regard, is that rail transportation is a twenty-four (24) hour operation while many of the industries it serves operate only during daylight hours. Often, a train makes good speed from origin to destination, only to be delayed several hours waiting to be unloaded Each hour of delay adds to the transportation costs as much as an additional twenty-five (25) miles of haul.

As an example of the efficiency of rail transport for bulk commodities, a train with a two-man crew pulling 1600 net tons at 55 miles per hour would be producing 32 times as many ton-miles per hour as a dump truck driver hauling 25 tons at 55 miles per hour.

Another problem affecting the efficiency of rail transportation for bulk commodities is that, under current methods, the quick unloading of a commodity train requires high capacity equipment and facilities which are idle most of the time. Such high-capacity equipment and facilities are expensive and add significantly to the investment costs per ton handled.

It is important for rail transportation of bulk commodities to offer ease of unloading and ease of transportation. This is particularly the case where aggregates and bulk material having a particle size ratio of over six are involved. (A particle size ratio of six means that the largest particles are no more than six times the size of the smallest particles.) Also, the amount of load that can be carried by the rail transportation system is a function of the center of gravity of the load. If the center of gravity of the load is too high, than less material can be carried. A high center of gravity will enhance the risk of derailing and/or toppling of hopper cars. Additionally, hopper cars that have relatively shallow walls and relatively small discharge openings will create difficulties when the material is desired to be discharged. With certain types of materials, the shallow walls will cause a "bridging" effect with the material within the hopper cars. Thus, it becomes difficult to unload the hopper car when the hopper car reaches the destination site.

There are many methods that are currently used for the unloading of bulk materials from trains. For example, bottom dumping hopper cars are equipped with automatic doors that are opened automatically as the cars move over a pit, where the pit facility includes a feeder and a conveyor. Either a pit or an elevated trestle is required for this method, so that this method is ruled out at many locations. Obviously, the providing of a pit or trestle facility with associated conveyor systems is expensive.

Another method involves the use of rotary car dumpers. These are commonly used for unloading coal at electric generated plants. Once again, the equipment for unloading the cars is highly specialized and expensive.

Side dumping cars have been used for many years. These side dumping cars, however, cannot be dumped on level ground. They require an elevated track on a built-up embankment, for example, so that the dumped material will flow over the side of the embankment an not flow back over the track.

In addition, backhoes or other unloading equipment are used to unload standard gondola cars. These methods are generally slow, promoting the delay problems mentioned above.

A significant development in the unloading of hopper cars occurred with the invention of U.S. Pat. No. 4,925,356, issuing on May 15, 1990 to the present inventor and to William B. Snead. U.S. Pat. No. 4,925,356 disclosed a self-unloading train for the transfer of bulk materials that comprises a plurality of hopper cars, a train conveyor, and a gating system. The plurality of hopper cars are coupled together to form a train Each hopper car has at least one hopper having walls inclined at shallow angles to the vertical and a bottom discharge opening having a width at least 50% of the distance between the wheels of the hopper cars. The train conveyor is an endless belt supported on the cars and underlying each of the hopper discharge openings. This endless belt receives the material discharged from the hopper discharge openings. The train conveyor extends the length of the plurality of hopper cars. The train conveyor has a width that is substantially greater than the width of the discharge openings. The gating systems are operable selectively so as to discharge material from the hoppers onto the train conveyor. In particular, these gating systems are made up of clam shell-type gates that are pivoted about the axis parallel to the train conveyor. These clam shell-type gates assist in controlling the flow of material onto the train conveyor.

The trailer car of this self-unloading train of U.S. Pat. No. 4,925,356 is positioned at the end of the plurality of hopper cars. The train conveyor extends to the trailer car. This trailer car supports a lift portion of the train conveyor at its discharge end sufficiently high to discharge the material to a transfer conveyor. This transfer conveyor is mounted on the trailer car so as to receive material from the train conveyor and to discharge the material at selected points surrounding the trailer car.

Each of the hopper cars of this invention has a center sill. The return run of the conveyor belt is supported by split return idlers disposed along each side of the center sill. The supply run of the conveyor belt is supported by catenary troughing idlers disposed immediately above the return run. A suitable drive system is provided for the train conveyor and the transfer conveyor. This drive system includes electric drive motors for the conveyor, a generator for providing electric power to the drive motors, and an internal combustion engine for driving the conveyor.

The actual embodiment of U.S. Pat. No. 4,925,356 has been very successful in actual operation. After extended use, it was found that this "Dump Train" should normally be unloaded on straight sections of track. Since the Dump Train has a substantial length, it was found that a restriction to the use of the Dump Train was that it must be unloaded on straight sections of track. If the train was unloaded on a curved section of track, then a great deal of deflection and distortion of the conveyor belt would occur. Any deflection or distortion of the conveyor belt, because of the curvature of the track, could minimize the effectiveness of the Dump Train and could cause extensive wear and damage to the conveyor belt. In many areas of the country, and in many desired unloading locations, it was found that straight sections of track were not readily available. As such, a need developed for enabling the Dump Train to be unloaded on curved sections of track. This would add greatly to the effectiveness of the Dump Train concept, would open up many more markets for the Dump Train, and would allow the Dump Train to be increasingly flexible to the needs of the user.

In the past, there has not been great experimentation with conveyor belts for traversing curves. Except in the specialized application of the Dump Train, it is much simpler for conveyor designers to design straight sections of conveyor belt which discharge onto adjacent straight sections of conveyor belt. There has seldom been a need for designing a curved section of conveying equipment.

Another problem with the Dump Train has been the cost of the transfer car. It is an expensive proposition to place a lift conveyor, and a transfer conveyor, on a single railroad car. In addition, a great deal of cost is required for the hydraulic system and power system for the operation of the transfer conveyor. The transfer conveyor also adds weight to the train. The tonnage of cargo that can be carried legally by a train would be offset by the weight of the transfer conveyor.

There are many locations, where material must be delivered, that already have suitable portable conveyor systems available. In many instances, it is only necessary to lift the material and to "dump" the material into an adjacent railroad car. As such, a need exists for presenting an economy version of the transfer car of the Dump Train which in particular eliminates the need for the large transfer conveyor.

The Dump Train utilizes a hopper car having four hoppers contained therein The Dump Trains is generally made up of ten hopper cars which extend for a considerable length. In many locales throughout the United States, it can be difficult to find such a long straight section of track so as to accommodate the full operation of the Dump Train. This is particular true when it is necessary to unload the Dump Train in remote locations where aggregate material for construction and maintenance purposes may be needed. As such, it was felt necessary to build a self-unloading train in which the cars are shorter and the conveyor belt could be trained so as to accommodate such curves.

The transfer car of the Dump Train includes a large amount of hydraulic and electrical equipment. The electrical equipment is utilized so as to power the conveyor system for the purpose of unloading the train. Since the Dump Train and the associated conveyor system are relatively large, a great deal of power is required. Unfortunately, the electrical equipment used on the transfer car of the Dump Train is quite heavy. Throughout the operation of the Dump Train, it is necessary for the Dump Train to carry along its own power supply. Therefore, it was felt desirable to provide a self-unloading train that could be actuated by external power systems. The minimization of weight also enhances the ability of the self-unloading train to carry a greater amount of cargo.

The Dump Train has been of a generally standard size. However, many users desire to have different sizes of trains depending on the type of job in which the train is employed. Many aggregate transportation jobs require only the capacity of a few of the available hopper cars. If the Dump Train were employed in such a setting then it would needlessly require the transport of unfilled cars. On the other hand, many jobs require much more aggregate material than could be conveniently carried in a single load of the Dump Train. In such a circumstance, it would be desirable to be able to add additional cars to the self-unloading train design so as to accommodate the entire amount of aggregate material required for a particular job. As such, it was felt desirable to have flexibility in the size and design of the self-unloading train.

It is an object of the present invention to provide a self-unloading train that is suitable for discharging material from curved sections of track.

It is another object of the present invention to provide a conveyor guide system that resists deflection and distortion of the conveyor belt when operating on curves.

It is another object of the present invention to provide a conveyor guide system that can be easily adapted for use on self-unloading trains It is still a further object of the present invention to provide a conveyor guide system for a self-unloading train that is economical and easy to operate.

These and other objects and advantages of the present invention will become apparent from a reading of the attached specification and appended claims.

SUMMARY OF THE INVENTION

The present invention is a self-unloading train for the transfer of bulk commodities. The self-unloading train of the present invention comprises a plurality of hopper cars coupled together, a train conveyor that comprises an endless belt underlying each of the hopper cars, and a conveyor guide system that is positioned adjacent the discharge end of the train conveyor and which exerts a downward force onto the upper surface of the train conveyor. Each of the plurality of hopper cars has a bottom hopper discharge opening. The train conveyor runs beneath this bottom hopper discharge opening so as to receive material as selectively discharged from the hopper cars. The train conveyor extends for the length of the plurality of hopper cars. The train conveyor has a discharge end that extends outwardly from the plurality of hopper cars.

Specifically, the present invention includes a trailer car that is connected to one end of the plurality of hopper cars. This trailer car supports a lift portion of the train conveyor adjacent to the discharge end of the train conveyor. The conveyor guide system is attached to this lift portion of the trailer car. The downward force exerted by the conveyor guide system is exerted onto the lift portion of the train conveyor.

The conveyor guide system specifically comprises a frame that is affixed generally adjacent to the discharge end of the train conveyor and a rotatable wheel that is connected to the frame. This wheel is in surface-to-surface contact with the upper surface of the train conveyor The frame is affixed to the trailer car. The rotatable wheel is in surface-to-surface contact with the train conveyor adjacent to the beginning of the lift portion of the train conveyor distal from the discharge end. An axle supports the rotatable wheel and is received by a housing. The wheel is freely rotatable relative to the housing. The downward force of the conveyor guide is generally equal to the force of upward deflection of the train conveyor when the conveyor system is supported on a curved track. The wheel of the conveyor guide includes an inflatable rubber tire that engages the troughed interior of the train conveyor.

The discharge end of the train conveyor extends around an end pulley. The end pulley is connected to the frame by a hydraulic piston and cylinder arrangement. This allows the end pulley to extend outwardly during discharge procedures. It also provides adjustable tautness to the train conveyor system.

Each of the hopper cars in the self-unloading train of the present invention has an articulated coupling to an adjacent hopper car. In addition, each of the hopper cars has a first side bearing on one side and a second side bearing on another side. The first and second side bearings of one hopper car overlap with the corresponding first and second side bearings on an adjacent hopper car. Also, the plurality of hopper cars are supported by a plurality of trucks on a railroad track. Each of the trucks is positioned beneath an articulated coupling between the hopper cars.

A power system is electrically connected to the train conveyor for actuating the train conveyor In the present invention, the power system is positioned independent of the plurality of hopper cars.

A training idler assembly is rotatably mounted to at least one of the plurality of hopper cars. This training idler assembly comprises a first catenary idler positioned beneath a supply run of the conveyor and a second catentary idler positioned beneath a return run of the train conveyor. The training idler assembly is rotatable relative to the curvature of the plurality of hopper cars.

The present invention also includes means for connecting the trailer car to a second plurality of hopper cars. The discharge end of the train conveyor is selectively actuable so as to extend the train conveyor over a portion of the second plurality of hopper cars. As described herein previously, the actuation of the hydraulics of the end pulley causes the train conveyor to extend outwardly beyond the end of the trailer car. This outward end extends over the opening of a hopper in the second plurality of hopper cars. A power cable extends for the length of these first and second plurality of hopper cars. The power cable of one of the plurality of hopper cars is interconnectable with another power cable on the other of the plurality of hopper cars.

DETAILED DESCRIPTION OF THE INVENTION

Figure 1:
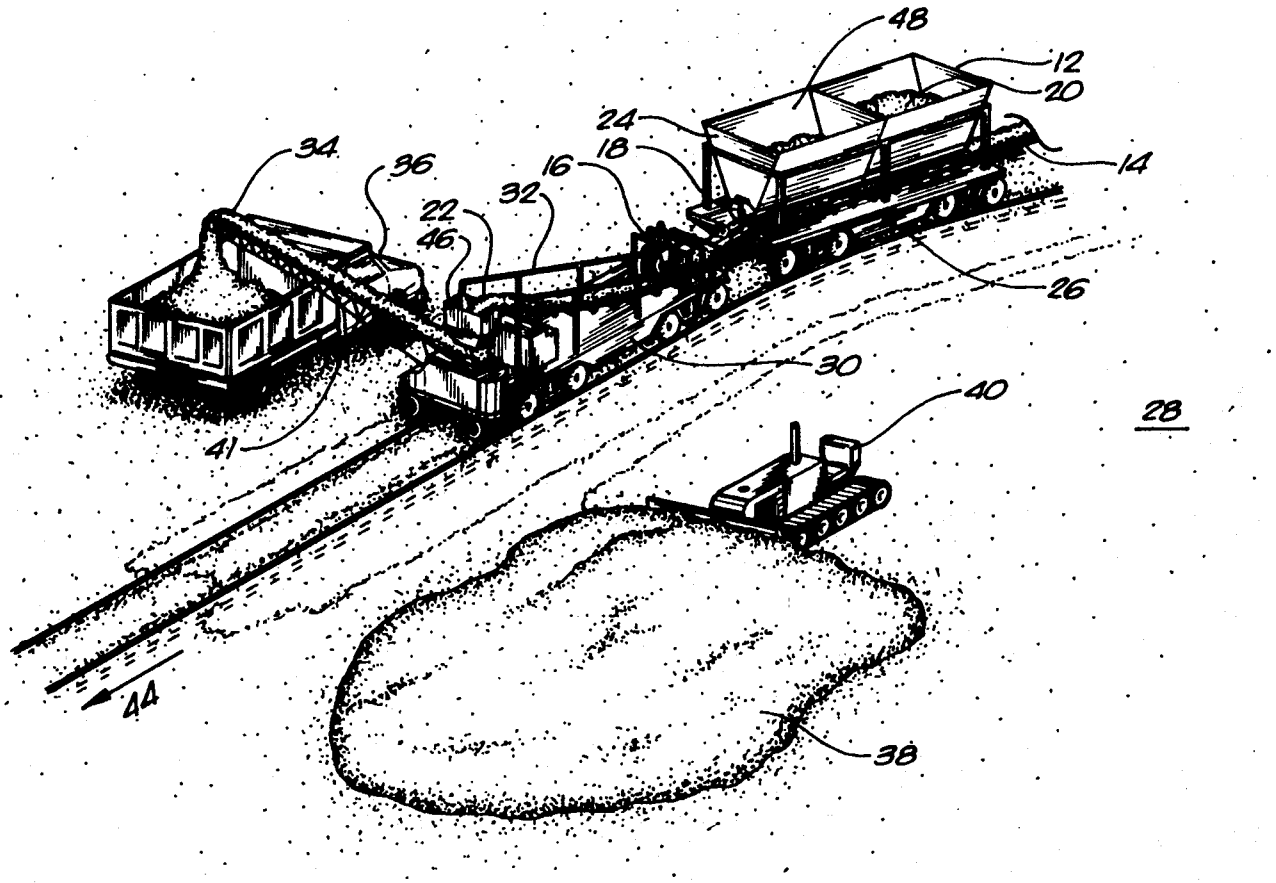
FIG. 1 is a perspective view showing the operation of the self-unloading train having the conveyor guide system of the present invention.

Referring to FIG. 1, there is shown at 10, a rearward portion of the self-unloading train for the transfer of bulk commodities. Self-unloading train 10 comprises hopper car 12, a train conveyor 14, and a conveyor guide system 16. Hopper car 12 is one of a plurality of hopper cars that form the present invention (as shown in FIG. 8). Hopper car 12 includes a bottom discharge opening 18. The train conveyor 14 comprises an endless belt which is supported on hopper car 12 and underlies the hopper discharge opening 18. Train conveyor 14 is configured so as to receive the bulk material 20 as discharged from the hopper cars 12. The train conveyor extends for the length of the plurality of hopper car. Train conveyor 14 includes a discharge end 22 that extends outwardly beyond the end 24 of hopper cars 12.

The conveyor guide system 16 is positioned between the discharge end 22 and the end 24 of hopper cars 12. This conveyor guide system 16 serves to exert a downward force onto the upper surface of train conveyor 14.

It can be seen in FIG. 1 that the self-unloading train 10 is supported on curved track 26. Track 26 is supported on area 28 in a position suitable for the discharge of material 20 from the hopper cars 12. In actual operation, the area 28 is the area in which the material is discharged for delivery elsewhere or for use at the site.

Trailer car 30 is connected to the end 24 of hopper car 12 by an articulated coupling. Trailer car 30 supports the lift portion 32 of the train conveyor 14. This lift portion 32 terminates at the discharge end 22 of train conveyor 14. The conveyor guide system 16 is attached to the lift portion 32 of the conveyor 14 Specifically, the conveyor guide system 16 is located at the beginning of the lift portion 32.

A portable conveyor 34 is positioned adjacent to the discharge end 22 of the lift portion 32 of train conveyor 14. This portable conveyor 34 serves to discharge material to selected points exterior of the trailer car 30. The portable conveyor 34 is shown as receiving material from the discharge end 22 of train conveyor 14 and transporting the material 20 into the container of dump truck 36. This portable conveyor 34 can be of a conventional configuration. The portable conveyor 34 can be positioned as needed beneath the discharge end 22 of train -conveyor 14. The portable conveyor 34 can also be used to deliver the aggregate 20 into a pile 38 as is illustrated in FIG. 1. A tractor-shovel 40 can then be used to move the material as desired.

The portable conveyor 34 is comprised of a continuous conveyor belt 41. The conveyor belt 41 traverses the point below the chute 46. Chute 46 is used to direct the material from the discharge end 22 onto the upper surface of conveyor belt 41 of portable conveyor 34. The portable conveyor is illustrated as having a body 41*a* which is wheeled into position adjacent to the discharge end 22 of the trailer car 30. The purpose of the portable conveyor 34 is to assist in the discharge operations of the self-unloading train 10.

The most important aspect of the present invention, as illustrated in FIG. 1, is the ability of the self-unloading train 10 to deliver material from curved sections of track. The conveyor guide system 16, to be described in detail hereinafter, maintains the proper training of the conveyor belt 14 so as to allow the self-unloading train to operate on the curved track 26. This greatly increases the ability of the self-unloading train 10 to operate on curved track environments. In addition, the conveyor guide system allows the conveyor belt 14 to make a sharper vertical turn. As such the discharge of material can occur in a much shorter distance.

In operation, the aggregate 20 is discharged from the discharge gate 18 of hopper car 12 onto conveyor 14. The material is delivered to the lift portion 32 and the discharge end 22 of conveyor 14. The material passes through chute 46 onto the top surface of the conveyor belt 41 on portable conveyor 34 from discharge end 22. In typical operation, each of the hoppers 48 of the hopper cars 12 are emptied sequentially onto the conveyor 14. In this manner, the contents of the hopper cars 12 are transferred as desired.

Although FIG. 1 shows the use of a portable conveyor 34, it should be kept in mind that various other portable conveyors can be used in combination with the self-unloading train 10 of the present invention. In particular, a truck mounted stacking conveyor could be used in place of the portable conveyor 34. Such a truck mounted stacking conveyor could carry a diesel-electric generator for powering the conveyor system of the self-unloading train. As such, the diesel-electric generator set required of the prior art systems are not required in the present invention. The portable conveyor itself can also carry the necessary power equipment for operating the conveyor system. Also, as is to be described hereinafter, the discharge end of train conveyor 14 can be positioned over the hopper of an adjacent hopper car configuration. The use of the portable conveyor, as shown in FIG. 1, is not intended to be a limitation of the present invention. The present invention offers a wide variety of discharge capabilities depending upon the particular application to which the self-unloading train 10 is placed.

Figure 2:
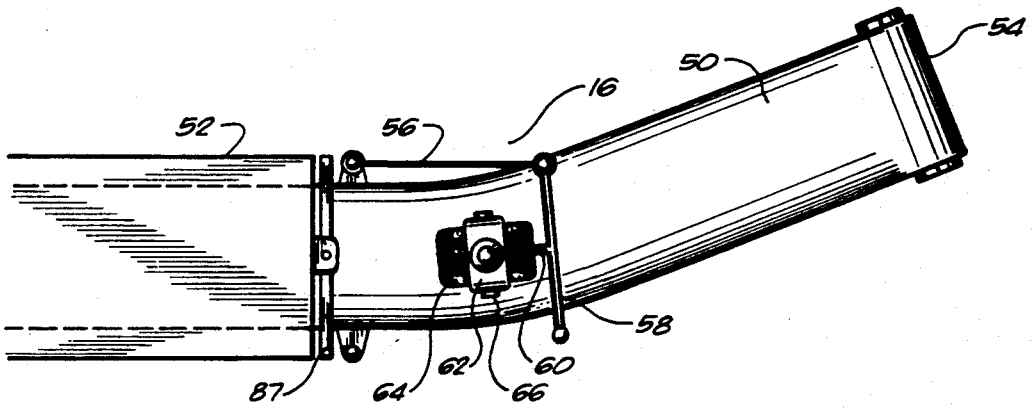
FIG. 2 is a top diagrammatic view of the simplest embodiment of the conveyor guide system of the present invention.

Referring to FIG. 2, there is shown at 16, the conveyor guide system in accordance with the present invention. Specifically, conveyor guide system 16 acts on the conveyor 50. Conveyor 50 extends from the end hopper car 52 through the conveyor guide system 16 and around discharge end 54. The conveyor guide system has a frame 56 that is attached to hopper car 52 and extends over the conveyor belt 50. The frame 56 is positioned generally adjacent to the discharge end 54 of train conveyor 50.

As shown in FIG. 2, frame 56 is a structure that includes member 58 extending across belt 50. A control bar 60 extends inwardly from member 58 generally at the midpoint of member 58. Control bar 60 is connected to housing 62. A wheel 64 is rotatably connected by axle 66 to housing 62. Wheel 64 is an inflatable rubber tire that is in surface-to-surface contact with the upper surface of conveyor belt 50. The strut 56 will act on the wheel 64 so as to change the angle of travel of wheel 64 in relation to the curvature of the conveyor belt 50. For proper belt training, the wheel 64 must turn slightly more than the angle between the cars.

Figure 3:
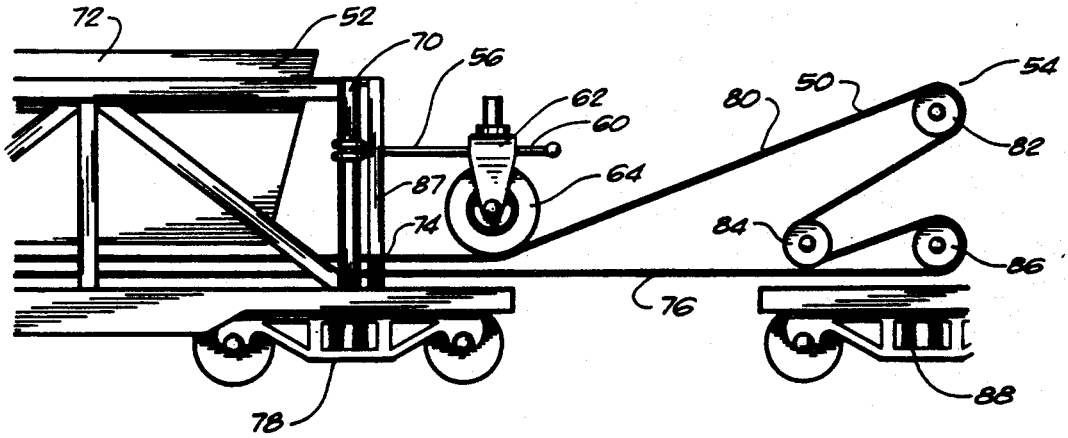
FIG. 3 is a side elevation view, in diagrammatic form, showing the simplest embodiment of the conveyor guide system of the present invention.

Although FIGS. 2 and 3 illustrate the use of a control bar for the purpose of changing the angle of travel of wheel 64 in relationship to the curvature of the conveyor belt 50, it is believed that the present invention can function properly in the absence of such a mechanism. If the wheel 64 is properly positioned, then the curvature of the belt can be maintained without angular adjustment of the travel of wheel 64. For the purposes of the present invention, the wheel 64 can be stated as having an angle of travel that is aligned with the longitudinal axis of the train 10. As such, the use of the strut and the angular adjustment of the wheel should not be construed as a limitation on the concept of the present invention. It is merely illustrative of the preferred embodiment of the present invention.

FIG. 3 is a side view of the illustration of FIG. 2. Specifically, it can be seen that the hopper car 52 includes a side frame portion 70 that supports the hoppers 72 of the hopper car 52. The hopper 72 discharges its material onto the supply run 74 of train conveyor 50. The supply run 74 of conveyor 50 runs directly beneath the discharge opening of hopper 72 of hopper car 52. The return run 76 of conveyor 50 extends directly beneath the supply run 74. The hopper car 52 is supported by trucks 78. Trucks 78 engage the rail on which they are supported. A strut 56 is connected to the side frame 70 of hopper car 52. Strut 56 extends outwardly in the manner illustrated in FIG. 2. It can be seen that the control bar 60 will extend inwardly and will engage the housing 62 of wheel 64. In FIG. 3, it can be seen that wheel 64 is in surface-to-surface contact with the upper surface 80 of train conveyor 50. Specifically, wheel 64 exerts a downward force onto the upper surface 80 of conveyor belt 50 so as to resist the upward deflection and distortion of belt 50 when it is necessary to operate belt 50 on curved sections of track. In addition, wheel 64 exerts the necessary downward force so as to allow belt 80 to make a relatively sharp vertical turn.

Belt 50 extends around end pulley 82 at the discharge end 54. On the return run, conveyor belt 50 will pass over pulley 84 and over pulley 86, in the manner illustrated. The discharge end 54 of conveyor belt 50 is supported by trucks 88 on the trailer car of the present invention.

FIGS. 2 and 3 also illustrate training idler assembly 87 which is positioned at the rear of hopper car 52. The training idler assembly will train both the supply run 74 of belt 50 and also train the return run 76 of belt 50. This training idler assembly is positioned at throughout the plurality of hopper cars in the self-unloading train of the present invention. This serves to train the belt 50 at every joint where the belt must turn significantly when dumping on a car. The training idler assembly, as shown in FIGS. 2 and 3, is pivotally mounted relative to the end of hopper cars 52.

Figure 4:
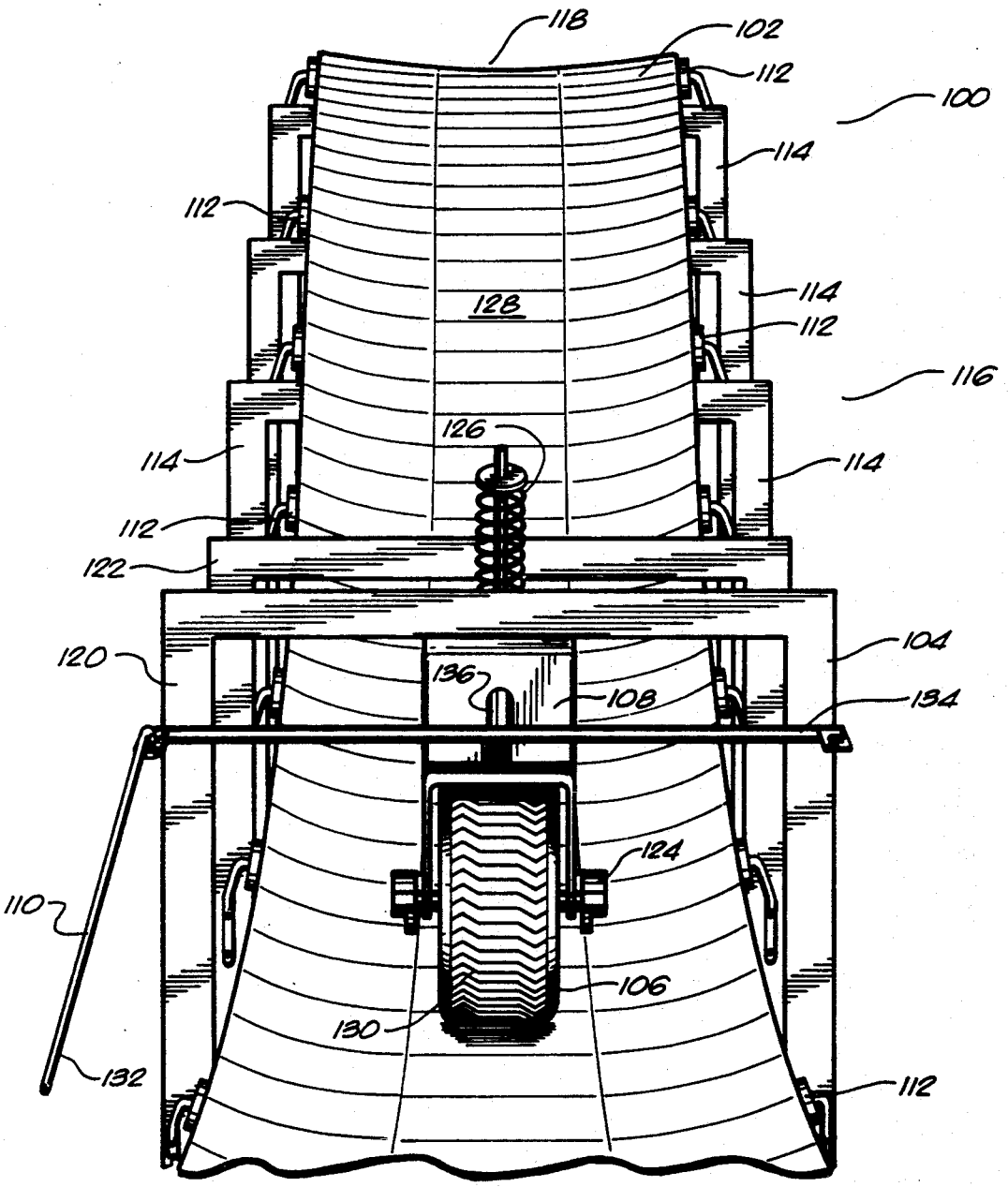
FIG. 4 is a view toward the discharge end of the train conveyor showing the preferred embodiment of the present invention.

FIG. 4 illustrates the preferred embodiment 100 of the present invention. FIG. 4 is a view of the conveyor guide system as viewed from the end of the plurality of hopper cars. In FIG. 4, conveyor guide system 100 includes the conveyor belt 102, frame 104, rotatable wheel 106, housing 108, and strut 110.

Figure 5:
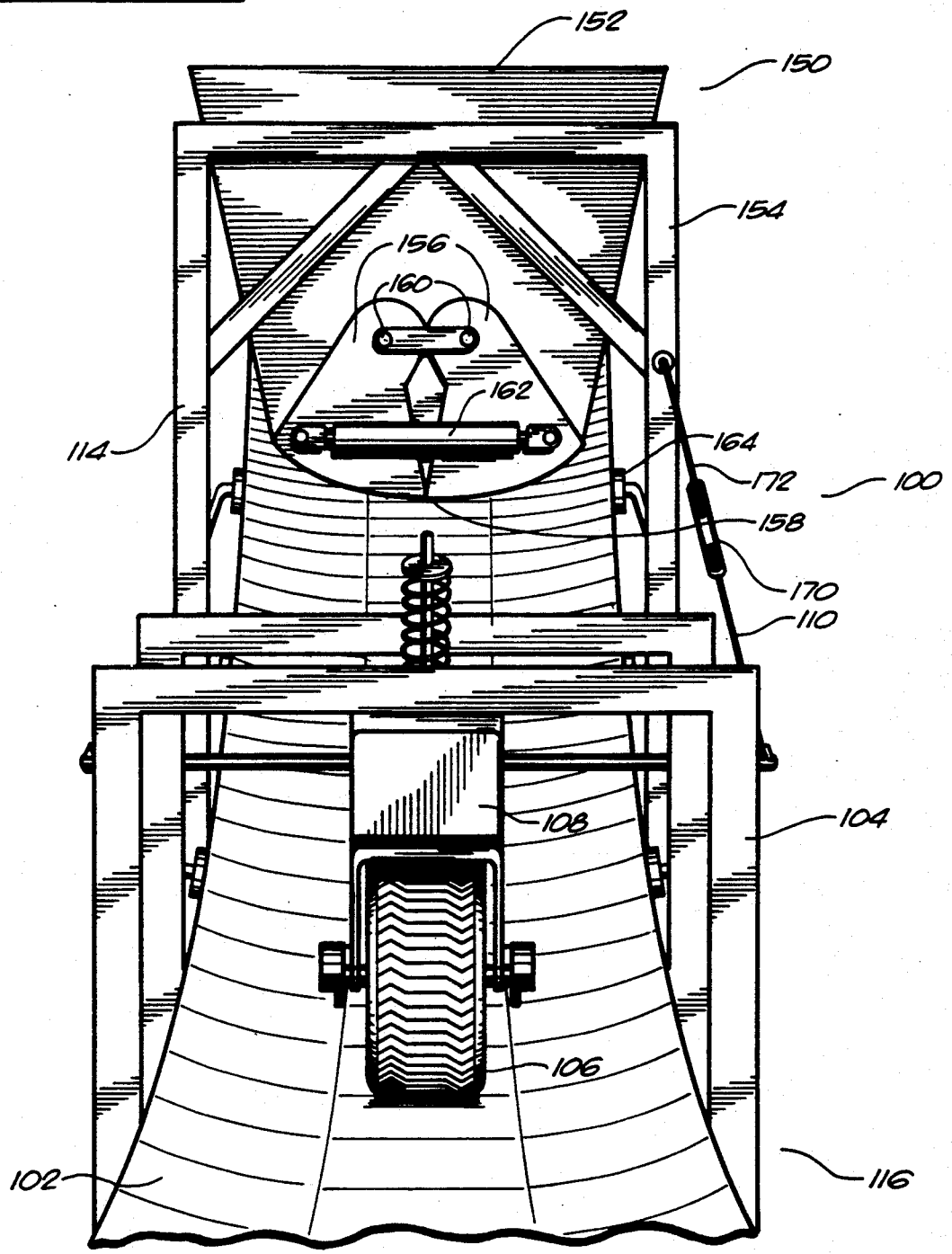
FIG. 5 is a view from the discharge end of the conveyor system looking toward the hopper cars of the present invention.

Conveyor belt 102 has a generally "troughed" configuration. This troughed configuration is necessary to contain the material being transported by conveyor 102. The rotatable wheel 106 should be centered within this trough so as to enhance this troughed configuration. Conveyor belt 102 is supported by a plurality of idlers 112. Idlers 112 are free rolling members that engage the bottom surface of the conveyor belt 102. Idlers 112 provide support to the conveyor belt 102 and serve to maintain the direction of travel of the conveyor 102. The idlers 112 are inclined inwardly and downwardly with respect to belt 102. The conveyor belt structure 114 is connected to the plurality of idlers and supports the supply and return runs of the belt conveyor 102. The conveyor support structure 114 is also connected to the plurality of hopper cars (as shown in FIG. 5). The configuration of the idlers and support structure generally extends for the length of the conveyor belt.

The conveyor support structure 114, as shown in FIG. 4, forms a lift portion 116 beyond the ends of the plurality of hopper cars. The illustration of FIG. 4 shows the conveyor support structure as positioned on the trailer car as illustrated in FIG. 1. The conveyor support structure 114 will carry the conveyor 102 to its discharge end 118. The lift portion 116 of the conveyor support structure 114 causes an upward incline in the conveyor belt 102. In this manner, the material carried on conveyor belt 102 will be "lifted" into the air so as to be discharged at end 118.

Frame 104 is connected to the conveyor support structure 114 and extends upwardly therefrom As shown in FIG. 4, frame 104 comprises a first bracket 120 and a second bracket 122. These brackets are welded, or otherwise attached, to the conveyor support structure 114. The housing 108 is connected to the support brackets 120 and 122 of frame 104. Specifically, housing 108 is in a rotatable relationship with respect to frame 104. Housing 108 receives the rotatable wheel 106 of the conveyor guide system of the present invention. Housing 108 receives the axle 124 that extends through wheel 106. Axle 124 allows the wheel 106 to rotate freely thereabout. A resistance member 126 extends above housing 108. Resistance member 126 exerts pressure onto the wheel 106 and, accordingly, onto the top surface 128 of conveyor belt 102.

Wheel 106 includes a tire 130 that is in surface-to-surface contact with the upper surface 128 of conveyor belt 102. Tire 130 is inflatable and is relatively wide. The width of tire 130 should be sufficient to distribute the force over a relatively large portion of the width of conveyor belt 102. Tire 130 includes a suitable tread for the purpose of frictional engagement with the conveyor belt 102. After experimentation, it was found that a tire which has a relatively low inflation pressure would be suitable for the purposes of the present invention. When delivering bulk commodities along conveyor 102 it will be necessary for the wheel 106 to travel over a portion of the commodity being conveyed The relatively large width and low inflation pressure will allow the wheel to accommodate this movement without undue resistance of the material or the conveyor belt 102.

The direction of wheel 106 is controlled by strut 110. Strut 110 includes a first bar 132 which is connected to a second bar 134. Bar 134 extends transverse to the direction of travel of conveyor belt 102 and includes a control bar 136. Control bar 136 is affixed to housing 108. The end of bar 132 is connected to the end of the plurality of hopper cars. Whenever there is displacement between the hopper car and the trailer car of the self-unloading train of the present invention, pressures will be exerted on strut 110 so as to cause wheel 106 to rotate and be angularly aligned with the curvature of belt 102. As stated previously, the wheel 106 must turn slightly more than the angle between the cars in order to cause proper training. In this manner, the tire 106 will exert forces so as to maintain the belt 102 in its proper position relative to idlers 112. The tire 106 should exert sufficient pressure against the conveyor belt 102 so as to prevent deflection and distortion caused by the curvature between the trailer car and the hopper cars and caused by the degree of lift of the conveyor belt. In this manner, the present invention accommodates curvature in the track. The amount of pressure exerted by wheel 106 on conveyor 102 can be controlled by an adjustment of the resistance member 126.

It should be noted that without the system of the present invention, the conveyor 102 will have a strong tendency (on curved truck) to become distorted and deformed so as to lift from the idlers 112 or slide from the conveyor support structure 114. Such distortion and deformation can cause a destruction of the conveyor belt by excess wear and tear.

Referring to FIG. 5, there is shown at 100 the conveyor guide system as viewed from the discharge end 118 of FIG. 4. In this view, it can be seen that the conveyor support structure 114 extends to the hopper car configuration. Specifically, in FIG. 5, the hopper car 150 is shown as having hopper 152 supported by side frame 154. Suitable bracketing and support structure is provided as part of the side frame 154. The hopper 152 includes clam shell gates 156 which cover the bottom discharge opening 158. Each of the clam shell gates are hydraulically actuated so as to pivot about axes 160. Axes 160 are parallel to and aligned with the conveyor belt 102. Upon the actuation of the hydraulic mechanism 162, the clam shell gates 156 open so as to pass the bulk commodity contained within hopper 152 onto conveyor belt 102. Idlers 164 support the conveyor belt 102 as it travels beneath the bottom discharge opening 158 of hopper car 150.

As the material is deposited upon conveyor belt 102, it travels from the end hopper car 150 to the trailer car 166. This is the beginning of the lift portion of the trailer car conveyor system. The conveyor guide system is placed at the beginning of the lift portion of the conveyor system. Frame 104 is attached to this beginning of the lift portion of the conveyor system. As can be seen, frame 104 supports the housing 108 in a rotatable manner. The wheel 106 is shown as exerting a downward force on the upper surface of conveyor belt 102. The configuration of conveyor guide system, as shown in FIG. 5, is substantially the same as that shown in FIG. 4.

It can be seen that strut 110 is connected to the side frame 154 of the hopper car 150. A suitable turnbuckle 170 is connected to strut 110 and to another strut 172 on the hopper car 150. Strut 110 extends between the hopper car 150 and the housing 108 of wheel 106. The angle of curvature will cause the housing 108 to rotate relative to the frame 104 so as to align wheel 106 with the curvature of conveyor 102.

The operation of the self-unloading train of the present invention is substantially similar to that of the self-unloading train described in U.S. Pat. No. 4,925,356, issued on May 15, 1990. Essentially, when it is desired to unload the hopper cars of the present invention, the conveyor belt 102 is tightened by hydraulic means, to be described hereinafter. The drive motors cause the conveyor belt to travel along t he idlers and to follow the conveying system. After the belt is tensioned and is moving, each of the hoppers 152 can be emptied by opening the clam shell gates. This causes material to drop from the hopper 152 onto the conveyor system and to pass to a desired location, The wheel 106 of the present invention will maintain the conveyor belt 102 in its proper position without significant deformation or distortion.

Figure 6:
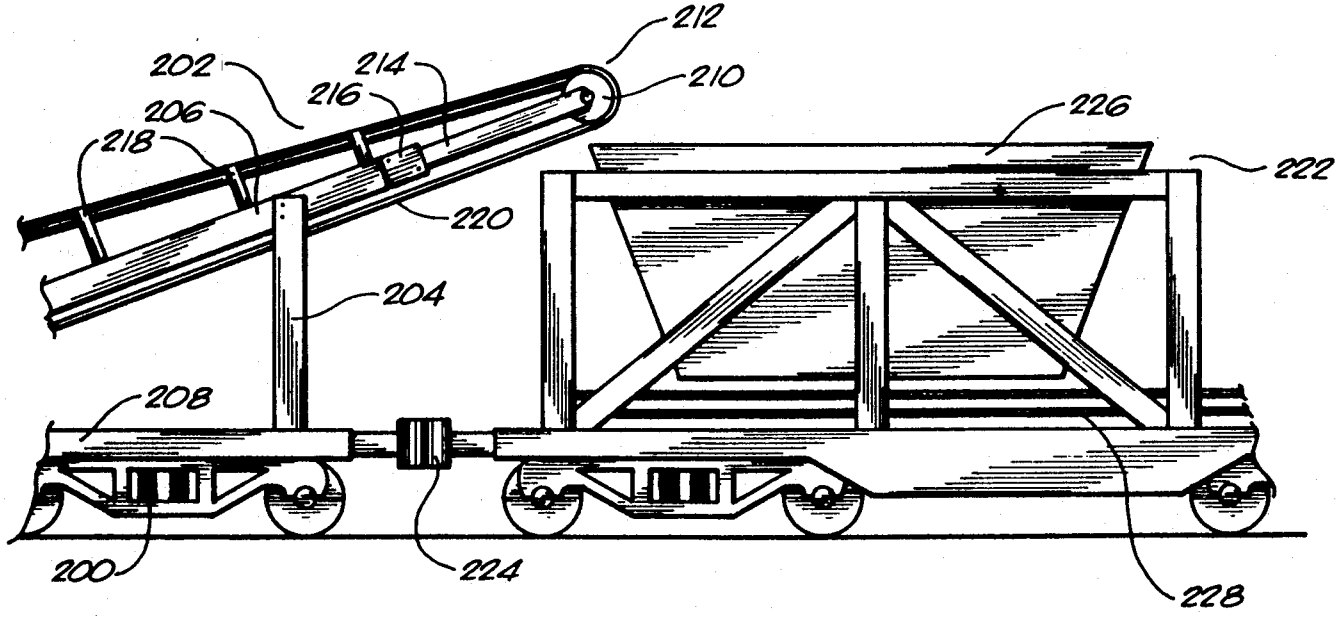
FIG. 6 is a side diagrammatic view showing the discharge mechanism of the present invention.

Referring to FIG. 6, there is shown an embodiment of the present invention which further illustrates the use of the present invention. In FIG. 6, it can be seen that the trailer car 200 supports the lift portion of the conveyor 202 thereabove. Support member 204 maintains the frame 206 of conveyor 202 in an angular position above the surface 208 of trailer car 200.

Importantly, in FIG. 6, it can be seen that the end pulley 210 receives the discharge end 212 of the conveyor 202. As such, material that travels along the upper surface of the conveyor 202 is discharged at the end 212 adjacent to the end pulley 210. End pulley 210 is connected by piston rod 214 to the frame 206. Importantly, the rod 214 is received by cylinder 216. With the actuation of hydraulic pressure, the telescoping rod 214 forces the end pulley 210 outwardly. This, in turn, causes the conveyor 202 to be fully extended in the position illustrated in FIG. 6. It also causes a tightening of the conveyor belt throughout the system of the present invention. As such, this serves the dual purpose of a belt tensioning system and as a discharge system.

As can be seen in FIG. 6, the conveyor 202 is supported by idlers 218. The return run 220 of conveyor belt 202 travels beneath the frame 206. When the end pulley 210 is in its retracted position adjacent to the cylinder 216 of frame 206, the return run 220 of conveyor 202 will be slack. The end pulley will be retracted so as to not extend beyond coupling 224. This is the typical position of the conveyor belt during travel. When the train comes to rest for the purpose of material discharge, the hydraulics of the present invention are actuated so as to cause the end pulley 210 to extend outwardly beyond the position of coupling 224.

With reference to FIG. 1, when the end pulley 210 is fully extended, then the aggregate material will be discharged over the discharge end 212 of conveyor belt 202. This material can then be deposited on the portable conveyor 34 illustrated in FIG. 1.

As an alternative operation, a hopper car 222 can be joined to trailer car 200 in the position illustrated in FIG. 6. The hopper car 222 can be rolled along t he tracks so as to engage the trailer car 200 by couplers or abutment members 224. It is only necessary that the hopper car 222 be in close proximity to the discharge end 212 of conveyor 202. In this position, the material carried by conveyor 202 can be passed over the discharge end 212 into the interior of hopper 226 of hopper car 222. After the hopper 226 is filled with the material, the hopper car 222 can be moved from the trailer car 220 for the purposes of transporting the material elsewhere.

Also, the embodiment illustrated in FIG. 6 can also be used so as to connect and disconnect long sections of self-unloading trains, to be described hereinafter. Each of the self-unloading trains of the present invention is made up of a plurality of hopper cars and a trailer car containing the conveyor mechanism. When another plurality of hopper cars are joined to one of the self-unloading trains, in the manner illustrated in FIG. 6, a long continuous system is developed. As such, the material can be discharged from the conveyor 202 into the hopper 226. By operating the conveyor belt 228 of the hopper car 222, any material deposited into hopper 226 can be transported elsewhere. As such, the conveyor system of the present invention provides additional flexibility for the discharge of aggregate materials in railroad operations.

Figure 7:
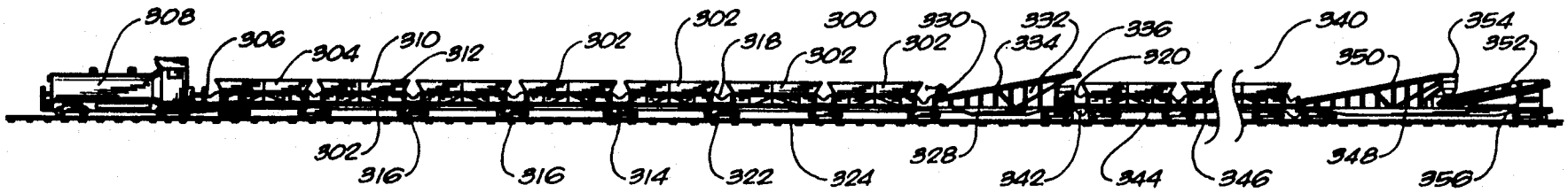
FIG. 7 is a side elevational view showing a complete arrangement of the self-unloading train in accordance with the the present invention.

FIG. 7 shows the self-unloading train 300 in accordance with the preferred embodiment of the present invention. Self-unloading train 300 includes a plurality of hopper cars 302. The first hopper car 304 is coupled, in a conventional fashion, at 306 to a locomotive 308. As can be seen, each of the hopper cars 302 have a special configuration. Each hopper car 302 has two hoppers 310 and 312. This is in contrast to the standard four hopper design. By designing the hopper cars 302 with two hoppers, rather than the conventional 4, each of the hopper cars 302 will be shorter. The ability to design the shorter hopper cars means that the oars can be built stronger or lighter. This also gives smaller angles between the cars on curves. As a result, better alignment on curves of the conveyor belt 314 can be achieved. This shorter style of hopper car 302 also means that the couplings have fewer wearing parts.

A particularly unique design incorporated into self-unloading train 300 is the use of overlapping side bearings 316. Specifically, each of the hopper cars 302 has a first side bearing on one side and a second side bearing on the other side. Each of these first and second side bearings overlap the corresponding first and second side bearings on an adjacent hopper car. These overlapping side bearings provide a lower natural frequency for the train and provide a smoother ride. There is no torque on the truck bolster due to the different weights in adjacent cars. As such, the overlapping side bearings provide an additional advantage for the use of a conveyor system on the arrangement of hopper cars of the present invention.

A power cable 318 extends throughout the length of the plurality of hopper cars 302. The power cable 318 terminates at the discharge end 320 of the self-unloading train 300. As such, this power cable 318 allows the self-unloading train 300 to be coupled to another such train or to a Dump Train.

Another important feature of the present invention is the articulated coupling between each of the cars 302. As can be seen, the trucks 322 reside in the area between each of the hopper cars 302. The trucks 322 support the hopper cars 302 in a rolling relationship with the railroad track 324. In contrast to conventional hopper designs, it can be seen that the trucks 322 are located at the couplings of the hopper cars 302, rather than at the end of each of the cars. The articulated couplings eliminate the vertical and horizontal freedom between the cars. As a result, it makes belt training easier for dumping on curves. The articulated couplings still allow freedom for roll, pitch, and yaw, but with only half as many wearing parts as standard couplings. In addition, the overlapping side bearings 316 eliminate the freedom of rolling between the cars. This forces the springs and the side frames to absorb the vertical irregularities in the track. This coupling of adjacent cars in the rolling axis more than doubles the mass of the torsional pendulum. This, consequently, reduces the natural rolling frequency so as to give the train a smoother ride on rough track.

Since the cars are shorter in the articulated train 300, each of the trucks 322 can carry only 130,000 pounds gross, or about fifty tons net. The prior art Dump Train has four hoppers per car which carry twenty-five tons per hopper. Two hoppers of the same length constitute a maximum load for an articulated car. Each car, in addition to carrying a load, must act as a beam carrying the load to the trucks at the ends of the car. The bending moments on a uniformly loaded beam increase with the square of its length. Therefore, a shorter car needs less structural strength and consequently, less weight.

With reference to FIG. 7, each of the hopper cars 302 include suitable discharge openings so as to allow each of the hopper cars 302 to discharge their contents on an underlying conveyor 314. The conveyor belt traverses the area underneath these discharge openings so as to pass the material to the trailer car 328. Trailer car 328 includes the conveyor guide mechanism 330. As can be seen, the trailer car 328 has a lift structure 332 that causes the conveyor belt 334 to lift upwardly. This corresponds with the configuration described herein previously.

A particularly unique feature of the present invention is the ability to adjust the discharge end 336 outwardly. The discharge end 336, as described herein previously, is coupled to suitable hydraulics so as to allow for the conveyor belt 314 to be appropriately tensioned. The lengthening of the discharge end 336 also allows the material conveyed on the conveyor belt 314 to be passed over the discharge end as needed.

FIG. 7 illustrates the use of a Dump Train 340 as coupled at 342 to the end of the trailer car 328 of self-unloading train 300. As can be seen, the hopper car 344 is coupled so as to be in position beneath the discharge end 336. As such, any material conveyed over the discharge end 336 can be discharged into the Dump Train 340. The use of the conveyor 346 causes the material to be transported to the transfer car 348. Transfer car 348 includes a lift conveyor 350 and a transfer conveyor 352. The lift conveyor 350 works in a similar fashion as the conveyor described herein previously. The material traverses the belt to the chute 354 so a to be discharged onto the transfer conveyor 352. The transfer conveyor 352 is suitable for delivering the material to any position exterior of the self-unloading train 300. A control cab 356 is positioned beneath the transfer conveyor 352. The Dump Train 340, as illustrated in FIG. 7, can be a conventional Dump Train utilizing the trailer car 348, and can also utilize the hopper car configurations of the self-unloading train 300. The particular usage of the Dump Train 340 is a matter of design choice As can be seen, the Dump Train 340 can be electrically coupled at 336 to the self-unloading train 300. Most railroads require that the engineer ride on the head end of a train. If the locomotives are all at one end, the train must be moved to a passing track after unloading, where the locomotives can be uncoupled and run around to the other end for the return trip. This requires more switching and time than is readily apparent. However, most locomotives are equipped for multiple-unit service. They have receptacles for 27-conductor cables at each end, which when connected, allow one engineer to control any number of locomotives from one station. The self-unloading train 300 is equipped with such a 27-conductor cable running its full length so as to allow locomotives at both ends to push and pull simultaneously under the control of a single engineer. The single engineer can walk the length of the train while it is unloaded and go home in the locomotive that came to the destination on the rear end of the train. As such, the present invention can eliminate the need to run a locomotive around the train for the return trip.

The configuration of the self-unloading train 300 allows the user to configure the train in a variety of different fashions. For example, several self-unloading trains 300 can be coupled together so as to carry large cargos. By sequentially opening the hoppers, and by sequentially operating the associated conveyor systems, the separate self-unloading trains 300 will pass their loads to the end of the train. As such, multiple self-unloading trains can be used for carrying large amounts of cargo.

Although FIG. 7 illustrates a self-unloading train 300 as having six hopper cars 302, the self-unloading train 300 can also be designed with more than six or fewer than six hopper cars. The size of the self-unloading train 300 is a matter of design choice and convenience. Under certain circumstances, the length of the train may be smaller so as to allow a more flexible coupling with other self-unloading trains. However, many more hopper cars 302 can be coupled together so as to afford economies of scale and to provide for larger hauling capacity. As stated previously, flexibility of design is a major advantage of the self-unloading train of the present invention.

The present invention achieves a number of advantages not found in the prior art. Specifically, the present invention allows the conveyor system to operate along curved railroad track. Additionally, this increases the ability of the self-unloading train to service areas that do not have long straight sections of track.

In the prior invention of the "Dump Train", a transfer conveyor was connected to the trailer car. The use of and operation of the transfer conveyor required a great deal of hydraulic equipment and power equipment. In many settings, this transfer conveyor was unnecessary equipment. After experimentation, it was found that there were many applications of the Dump Train that did not require the operation of the transfer conveyor. Furthermore, since the weight of material that can be carried by trains is limited by law, the transfer conveyor, and its associated equipment, consumed a great deal of the weight available for cargo transport. The removal of the transfer conveyor allows additional cargo capacity to be available for the hopper cars of the train. As such, the present invention offers certain advantages, of cost and cargo capacity, that are not found in the prior invention of the "Dump Train".

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A self-unloading train for transfer of bulk material comprising:

a plurality of hopper cars, each of said plurality of hopper cars having a bottom hopper discharge opening, each of said plurality of hopper cars having means thereon for closing said opening;

a coupling means formed on said plurality of hopper cars for joining said plurality of hopper cars together;

a train conveyor comprising an endless belt having a upper troughed configuration to contain the material, said hopper cars having means thereon for supporting at least a portion of said endless belt beneath said hopper discharge opening in a position so as to receive material discharged from said hopper cars, said train conveyor extending for a length of said plurality of said hopper cars, said train conveyor having a discharge end extending outwardly from said plurality of hopper cars, said discharge end positioned above a level of said hopper discharge openings; and rotatable conveyor guide means positioned adjacent said discharge end, said conveyor guide means for exerting a downward force onto an upper surface of said train conveyor sufficient to resist an upward deflection of said endless belt between said discharge end and said portion beneath said hopper discharge opening and to enhance the troughed configuration.

2. The train of claim 1, further comprising:

a trailer car connected to one end of said plurality of hopper cars, said trailer car supporting a lift portion of said train conveyor, said lift portion extending between said discharge end and said portion beneath said hopper discharge opening.

3. The train of claim 2, said conveyor guide means attached to said lift portion of said trailer car, said conveyor guide means for exerting said downward force onto a portion of said train conveyor traversing said lift portion.

4. The train of claim 2, further comprising:

means for connecting said trailer car to a second plurality of hopper cars, said discharge end of said train conveyor selectively actuable so as to extend said train conveyor over a portion of said second plurality of hopper cars.

5. The train of claim 4, said means for connecting having a power cable extending for a length of said first and second plurality of hopper cars, said power cable of one of said plurality of hopper cars interconnectable with another of said plurality of hopper cars.

6. The train of claim 1, said conveyor guide means comprising:

a frame affixed generally adjacent said discharge end of said train conveyor; and a rotatable wheel connected to said frame, said rotatable wheel being in surface-to-surface contact with said upper surface of said train conveyor. .

7. The train of claim 6, said frame being affixed to a trailer car rearward of said plurality of hopper cars, said trailer car supporting a lift portion of said train conveyor, said discharge end being at an end of said lift portion opposite said hopper cars.

8. The train of claim 7, said rotatable wheel being in surface-to-surface contact with said train conveyor adjacent a beginning of said lift portion of said train conveyor.

9. The train of claim 6, further comprising:

a housing rotatably connected to said frame; and an axle supporting said rotatable wheel, said housing receiving said axle, said wheel being freely rotatable relative to said housing.

10. The train of claim 9, further comprising:

a strut affixed at one end to an end of said plurality of hopper cars, said strut connected at another end to said housing, said strut causing said housing to rotate relative to a curvature of said train conveyor.

11. The train of claim 1, said conveyor guide means comprising:

a strut extending outwardly from an end car of said plurality of hopper cars; and a rotatable wheel connected to said strut, said rotatable wheel being in surface-to-surface contact with said upper surface of said train conveyor, said rotatable wheel exerting said downward force onto said train conveyor.

12. The train of claim 11, said strut connected to said rotatable wheel so as to adjust an angle of travel of said wheel relative to a curvature of said plurality of hopper cars.

13. The train of claim 1, said discharge end of said train conveyor comprising:

a frame;

an end pulley interconnected to said frame, said train conveyor extending around an exterior surface of said end pulley; and adjustment means extending between said end pulley and said frame, said adjustment means for changing the distance between said end pulley and said frame.

14. The train of claim 13, said adjustment means comprising:

a piston rod connected at one end to said end pulley;

a cylinder connected to said frame and receiving an end of said piston rod; and a hydraulic actuator acting on said cylinder so as to move said piston rod relative to said frame.

15. The train of claim 1, said coupling means comprising an articulated coupling extending between one of said hopper cars and an adjacent hopper car.

16. The train of claim 15, said plurality of hopper cars having a plurality of trucks supporting said hopper cars on a railroad track, each of said plurality of trucks positioned directly beneath said articulated coupling between said hopper cars.

17. The train of claim 1, further comprising:

power means electrically connected to said train conveyor for actuating said train conveyor.

18. The train of claim 1, further comprising:

a transfer conveyor positioned rearward of said discharge end of said train conveyor, said train conveyor for delivering material to said transfer conveyor, said transfer conveyor for delivering said material to a position angularly offset from said train conveyor.

* * * * *